US006530441B1

(12) United States Patent
Singh et al.

(10) Patent No.: US 6,530,441 B1
(45) Date of Patent: Mar. 11, 2003

(54) CUTTING ELEMENT GEOMETRY FOR ROLLER CONE DRILL BIT

(75) Inventors: Amardeep Singh, Houston, TX (US); Sujian Huang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/604,232

(22) Filed: Jun. 27, 2000

(51) Int. Cl.[7] ..... E21B 10/16
(52) U.S. Cl. ..... 175/431; 175/428; 76/108.2
(58) Field of Search ..... 175/341, 319, 175/378, 428, 430, 431; 76/108.2

(56) References Cited

U.S. PATENT DOCUMENTS

| | | | | | |
|---|---|---|---|---|---|
| 3,800,891 | A | * | 4/1974 | White et al. | 175/374 |
| 4,408,671 | A | | 10/1983 | Munson | 175/377 |
| 4,611,673 | A | | 9/1986 | Childers et al. | 175/340 |
| 4,657,093 | A | | 4/1987 | Schumacher | 175/353 |
| 4,673,044 | A | * | 6/1987 | Bigelow et al. | 175/329 |
| 4,726,432 | A | | 2/1988 | Scott et al. | 175/375 |
| 4,848,476 | A | | 7/1989 | Deane et al. | 175/340 |
| 5,152,194 | A | | 10/1992 | Keshavan et al. | 76/108.2 |
| 5,201,376 | A | | 4/1993 | Williams | 175/374 |
| 5,341,890 | A | | 8/1994 | Cawthorne et al. | 175/374 |
| 5,351,769 | A | | 10/1994 | Scott et al. | 175/374 |
| 5,351,771 | A | | 10/1994 | Zahradnik | 175/374 |
| 5,372,210 | A | | 12/1994 | Harrell | 175/431 |
| 5,394,952 | A | | 3/1995 | Johns et al. | 175/332 |
| 5,421,423 | A | * | 6/1995 | Huffstutler | 175/374 |
| 5,542,485 | A | | 8/1996 | Pessier et al. | 175/371 |
| 5,791,423 | A | | 8/1998 | Overstreet et al. | 175/375 |
| 5,813,480 | A | | 9/1998 | Zaleski, Jr. et al. | 175/40 |
| 5,819,861 | A | | 10/1998 | Scott et al. | 175/371 |
| 5,833,020 | A | | 11/1998 | Portwood et al. | 175/331 |
| 5,839,256 | A | | 11/1998 | Cisneros et al. | 175/431 |
| 5,868,213 | A | * | 2/1999 | Cisneros et al. | 175/331 |
| 5,915,486 | A | | 6/1999 | Portwood et al. | 175/374 |
| 5,967,245 | A | | 10/1999 | Garcia et al. | 175/374 |
| 5,979,575 | A | | 11/1999 | Overstreet et al. | 175/374 |
| 6,029,759 | A | | 2/2000 | Sue et al. | 175/374 |
| 6,045,440 | A | * | 4/2000 | Johnson et al. | 175/432 |
| 6,045,750 | A | | 4/2000 | Drake et al. | 419/6 |
| 6,057,784 | A | | 5/2000 | Schaaf et al. | 340/854.4 |
| 6,059,054 | A | | 5/2000 | Portwood et al. | 175/430 |

FOREIGN PATENT DOCUMENTS

| | | |
|---|---|---|
| WO | WO 00/12859 | 3/2000 |
| WO | WO 00/12860 | 3/2000 |

OTHER PUBLICATIONS

Great Britain Search Report dated Aug. 31, 2001; 4 pages.
Ma Dekun et al., "The Operational Mechanics of the Rock Bit", Petroleum Industry Press, 1996, pp. 1–243.

* cited by examiner

*Primary Examiner*—David Bagnell
*Assistant Examiner*—Daniel P Stephenson
(74) *Attorney, Agent, or Firm*—Rosenthal & Osha L.L.P.

(57) ABSTRACT

A roller cone drill bit for drilling earth formations is disclosed. The bit includes a bit body and a plurality of roller cones attached to the bit body and able to rotate with respect to the bit body. The drill bit includes plurality of cutting elements disposed on each of the roller cones such that at least one of the cutting elements includes a step shaped crest on its outer surface. In one embodiment, the step shaped crest includes a difference in extent between a more extensive and less extensive crest segment selected to correspond to a penetration depth in a particular earth formation at which fracture failure is expected. Other embodiments include one or more flank surfaces having more and less extensive surfaces thereon corresponding to the more and less extensive crest segments.

16 Claims, 4 Drawing Sheets

CUTTING ELEMENT GEOMETRY FOR ROLLER CONE DRILL BIT

BACKGROUND OF THE INVENTION

The invention relates generally to roller cone drill bits for drilling earth formations, and more specifically to the geometry of cutting elements on roller cone drill bits. In particular, the invention provides tooth configurations for milled tooth roller cone drill bits.

FIG. 1 shows one example of a roller cone drill bit used in a conventional drilling system for drilling a well bore in an earth formation. The drilling system includes a drilling rig 10 used to turn a drill string 12 which extends downward into a well bore 14. Connected to the end of the drill string 12 is roller cone-type drill bit 20, shown in further detail in FIG. 2.

Roller cone bits 20 typically comprise a bit body 22 having an externally threaded connection at one end 24, and a plurality of roller cones 26 (usually three as shown) attached at the other end of the bit body 22 and able to rotate with respect to the bit body 22. Disposed on each of the cones 26 of the bit 20 are a plurality of cutting elements 28 typically arranged in rows about the surface of the cones 26. The cutting elements 28 may comprise tungsten carbide inserts, polycrystalline diamond compacts, or milled steel teeth.

In roller cone bits, the cutting elements drill the earth formation by a combination of compressive fracturing and shearing action. Prior art milled tooth bits typically have teeth formed from steel or other easily machinable high-strength material, to which is applied in many cases a hardface overlay such as from tungsten carbide or other wear resistant materials. The hardfacing is applied by any one of a number of well known methods. There are a number of references which describe specialized exterior surface shapes for the substrate. The specialized shapes are intended to provide a cutting structure which includes more thickness of hardface overlay in wear-prone areas, so that the useful life of the teeth can be increased. Examples of such specialized substrate shapes are shown in U.S. Pat. Nos. 5,791,423, 5,351,771, 5,351,769, and 5,152,194, for example. These references show that the teeth have substantially regular trapezoidal exterior hardface surfaces. The irregular shape of the substrate outer surface is selected to provide additional hardface in the wear prone areas while maintaining a conventional exterior tooth surface.

U.S. Pat. No. 6,029,759 issued to Sue et al shows a milled tooth drill bit having teeth in a gage row (the outermost row of teeth on any cone used to maintain full drilling diameter), where these teeth have a particular outer surface. See for example FIG. 12B in Sue et al '759. The particular outer surface of these teeth is intended to make it easier to apply hardfacing in two layers, using two different materials. The purpose of such tooth structures is to have selected hardfacing materials positioned to correspond to the level of expected wear on the various positions about the outer surface of the tooth.

SUMMARY OF THE INVENTION

The invention is a roller cone drill bit for drilling earth formations including a bit body and a plurality of roller cones attached to the bit body and able to rotate with respect to the bit body. Each of the roller cones has cutting elements disposed on it. At least one of the cutting elements includes a step shaped crest. In one embodiment, the at least one cutting element having the step shaped crest is disposed in an innermost row on one of the cones. In another embodiment, the cutting element having the step shaped crest is disposed in a row disposed between the innermost row and a gage row on one of the cones. In another embodiment, the cutting element having the step shaped crest is disposed in the gage row, wherein the axially more extensive part of the step is disposed on the gage-facing side of the cutting element.

The step shaped crest includes a more extensive segment and an axially less extensive segment along the cutting element. In a particular embodiment, the step shaped crest further includes a more extensive flank surface and a less extensive flank surface on at least one flank of the cutting element. In another embodiment, the step shape includes a more extensive segment along the crest, and two less extensive segments along the crest disposed on either side of the more extensive segment.

In a particular embodiment, the difference between the axial extent of the more extensive segment and the less extensive segment is selected to correspond to a penetration depth at which a selected earth formation is first subject to fracture-type failure during drilling.

DETAILED DESCRIPTION OF THE INVENTION

Figure 3:
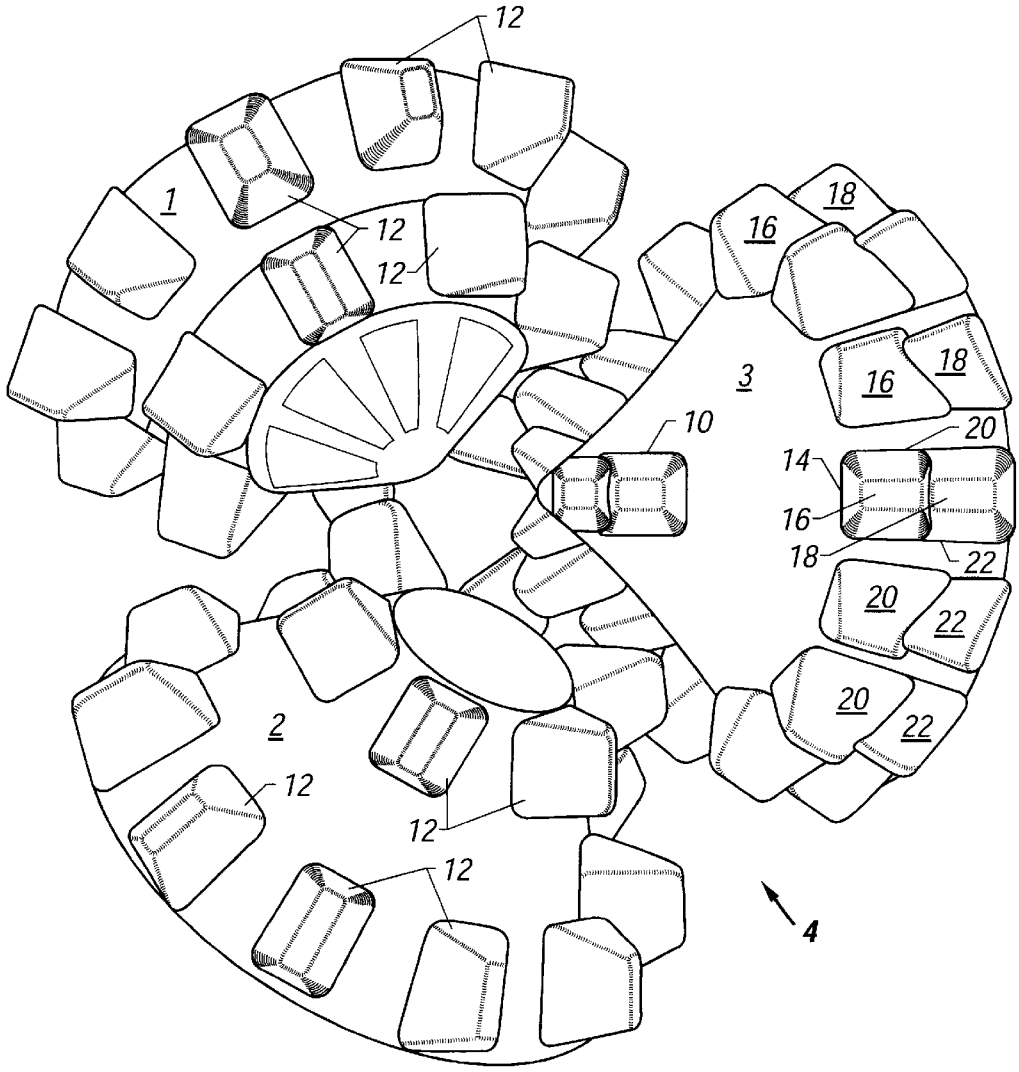
FIG. 3 shows an bottom view of a roller cone drill bit including various exemplary embodiments of a step crest cutting element according to the invention.

FIG. 3 shows a bottom view of a roller cone drill bit 4 including roller cones 1, 2, 3. Each of the cones, 1, 2, 3 includes a plurality of milled teeth. The milled teeth can include those having a substantially regular trapezoidal exterior surface shape, such as shown at 12. Other teeth include a step-shaped crest thereon in various configurations which will be further explained. Examples of such step-shaped crest milled teeth are shown in FIG. 3 at 10 and 14. The number of such teeth having the step-shaped crests, such as 10 and 14, and the ones of the cones 1, 2, 3 on which such milled teeth are disposed is a matter of discretion for the bit designer and is not intended to limit the invention. Although the example shown in FIG. 3 includes such step-crest teeth only on cone 3, step crest teeth can be placed on any or all of the cones 1, 2, 3 in any particular embodiment of a roller cone bit according to this invention.

It should also be clearly understood that while the invention is described herein with reference to milled tooth drill bits, the step crest shape of the exterior surface of selected cutting elements on a drill bit according to the invention is not limited to milled tooth bits. Other roller cone bits known in the art, including those having cutting elements which are inserts made from hard material, such as tungsten carbide, and/or superhard material, such as diamond or boron nitride, are also within the scope of this invention.

Figure 1:
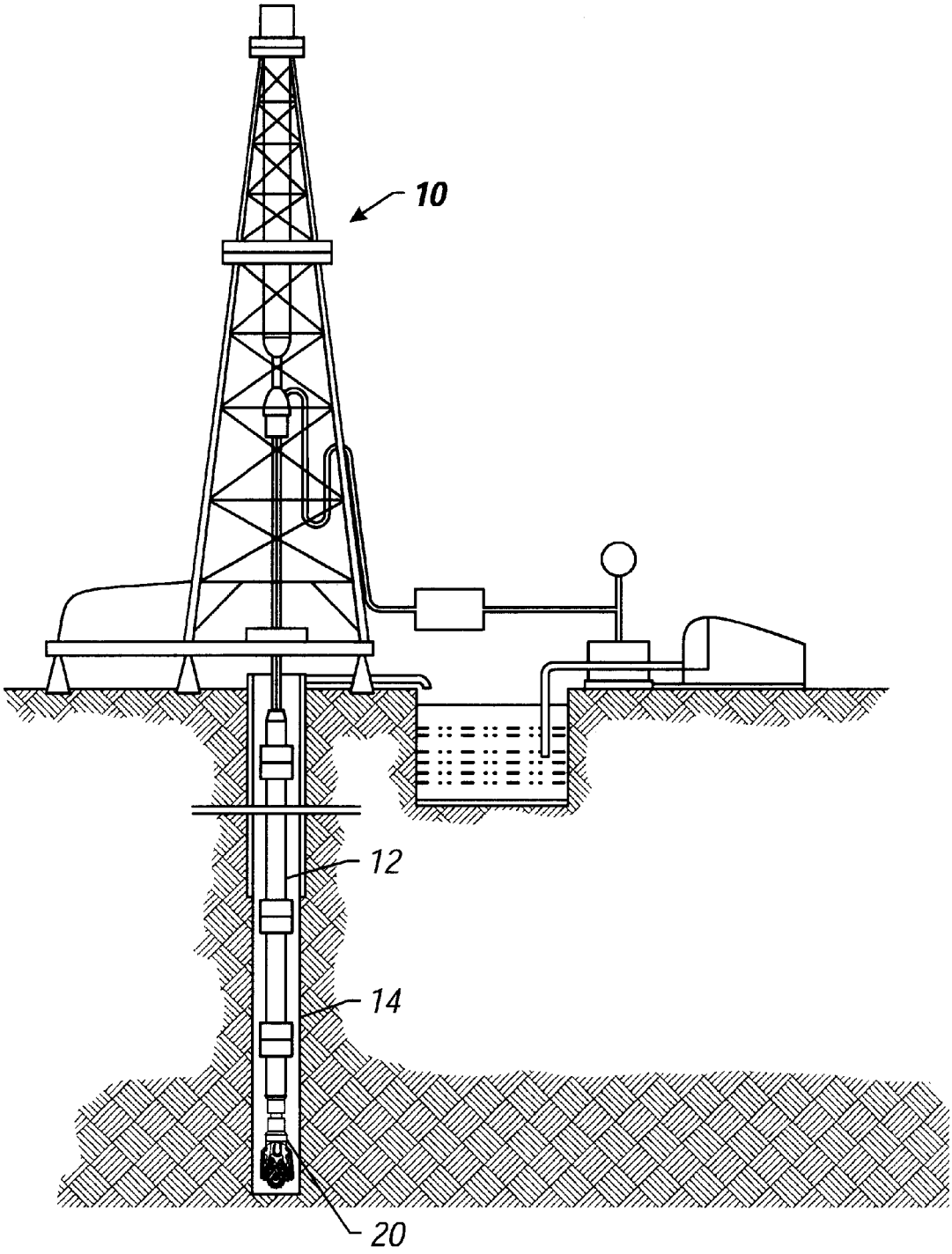
FIG. 1 (Prior Art)
FIG. 1 shows a schematic diagram of a drilling system for drilling earth formations having a drill string attached at one end to a roller cone drill bit.
Figure 2:
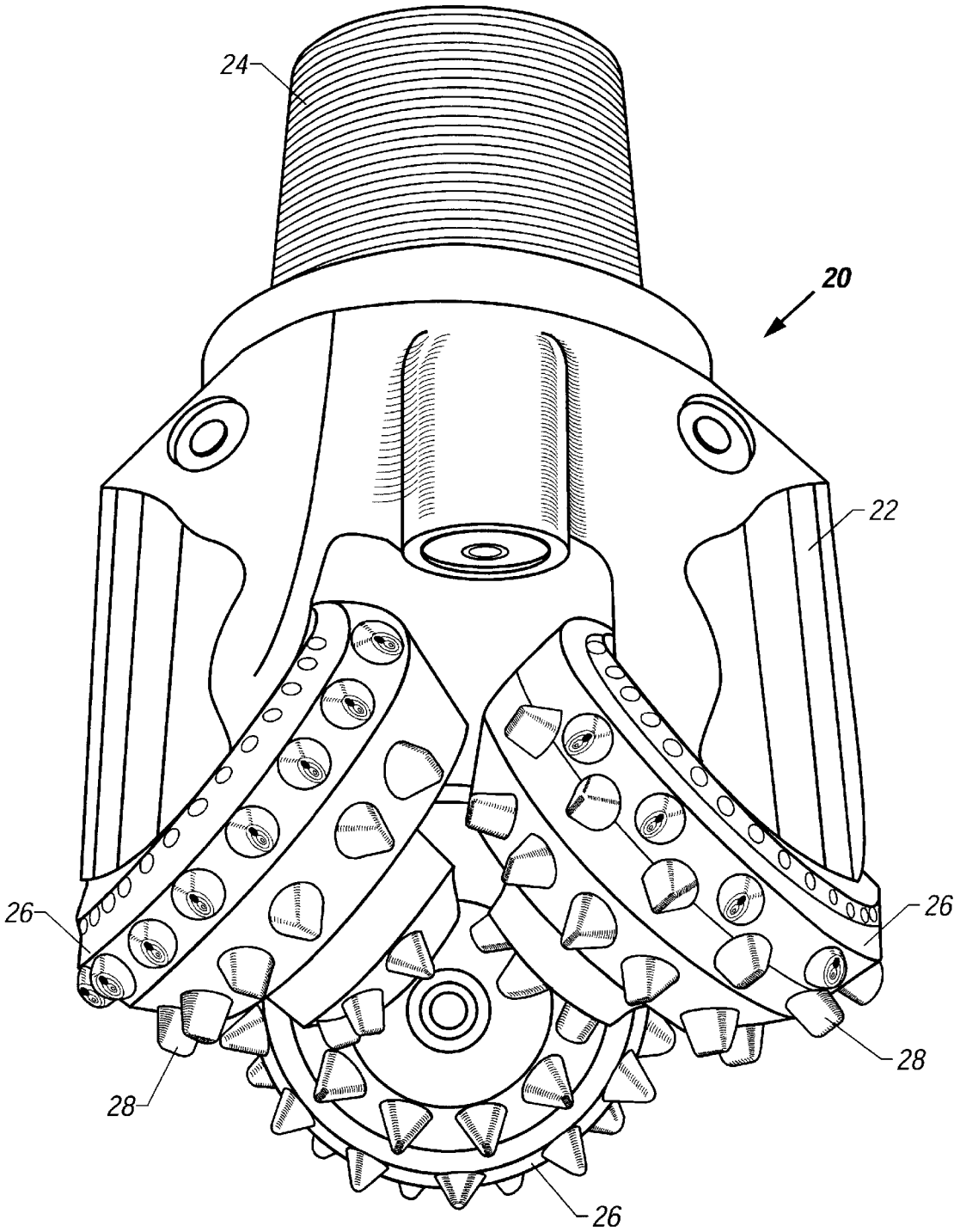
FIG. 2 (Prior Art)
FIG. 2 shows a prior art roller cone bit in more detail.

The step crest tooth (or cutting element) according to the invention, for example, cutting element 14, includes a more extensive crest segment 16, and a less extensive crest segment 18. The step crest cutting element 14 may also include a more extensive flank surface 20 and a less extensive flank surface 22 positioned to correspond to the more extensive crest segment 16 and less extensive crest segment 18, respectively. Although the step crest cutting element 14 shown in FIG. 2 includes more extensive 20 and less extensive 22 flank surfaces on both leading and trailing flanks of the cutting element 14, it should be understood that a step crest cutting element according to the invention may include such more extensive and less extensive flank surfaces on only one flank, or on neither flank of the step crest cutting element 14. It is only necessary to include the more extensive and less extensive crest segments, such as 16 and 18, in any one cutting element to make a drill bit according to the invention.

Figure 4:
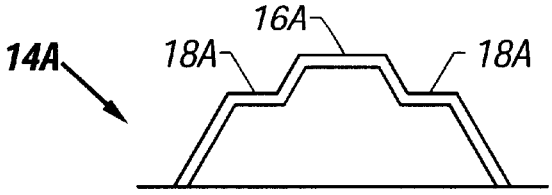
FIG. 4 shows a side view of an alternative embodiment of the step crest cutting element shown in FIG. 3 including two less extensive crest segments.

Another embodiment of the step crest cutting element is shown in side view in FIG. 4 at 14A. The embodiment shown in FIG. 4 includes a more extensive crest segment 16A as in the previous embodiment, but includes two less extensive crest segments 18A disposed on either side of the more extensive crest segment 16A.

Figure 5:
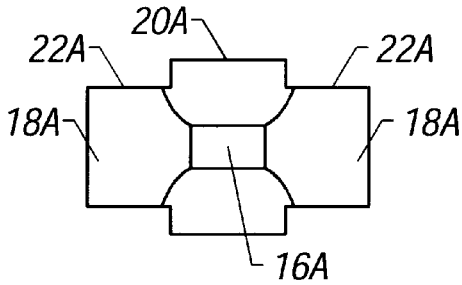
FIG. 5 shows an end view of the cutting element shown in FIG. 3.

An end view of the embodiment of FIG. 4 is shown in FIG. 5. Also shown in FIG. 5, the embodiment of the step crest cutting element which includes two less extensive crest segments 18A, may, in addition, include corresponding more extensive 20A and less extensive 22A flank surfaces, on either or on both flanks of the cutting element 14A. As in the previous embodiment, the more extensive and less extensive flank surfaces may be included on either, both or neither flank.

Generally speaking, the purpose of providing a step crest cutting element according to the invention is to improve the efficiency with which a roller cone drill bit drills through earth formations. The performance of such step crest teeth was analyzed using a method for simulating the drilling performance of roller cone bits drilling earth formation described in a patent application filed in the United States on Mar. 13, 2000, entitled "Method for Simulating the Drilling of Roller Cone Drill Bits and its Application to Roller Cone Drill Bit Design and Performance" and assigned to the assignee of this invention, incorporated herein by reference. As described in that patent application, the interaction between earth formations and various types of cutting elements has been characterized by a relationship between axial force exerted on the cutting element and the depth (axial distance) to which the cutting element penetrates the formation. It has been observed, particularly where the cutting element has a typical shape which increases cross sectional area closer to the "root" of the cutting element, that the relationship between axial force and depth of penetration includes sections where increasing the depth of penetration does not include a corresponding increase in force. These sections have been interpreted as resulting from fracture of the earth formation under the axial stress exerted by the cutting element. A penetration depth at which the first fracture failure is likely to occur is described in the above patent application. Typically the fracture failure depth for a particular formation and a particular cutting element is determined by laboratory experiment, also described in the above patent application.

Figure 6:
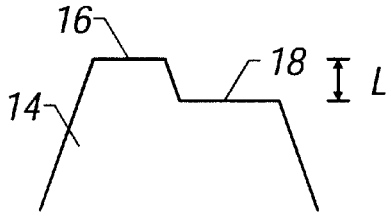
FIG. 6 shows an example of a particularly selected difference in axial extent between the crest segments of the step crest cutting element shown in FIG. 3.

In a particular embodiment of the invention, and referring to FIG. 6, the difference in extent L between the more extensive 16 and less extensive 18 crest segments on the cutting element 14 is selected to approximately match the penetration depth at which the first fracture type failure is likely to occur with a particular type of cutting element for a particular earth formation. The difference in extent L selected for a particular drill bit in accordance with this embodiment is related, therefore, to the type of earth formation expected to be drilled with the bit. A value for L which has been shown to work well over a range of earth formation types typically drilled using a milled tooth bit is about 0.200 inches (0.51 cm).

Figure 7:
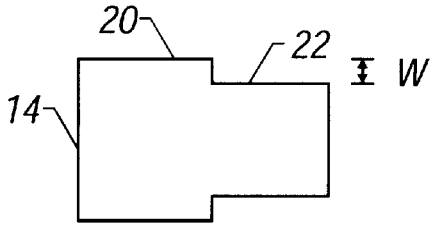
FIG. 7 shows an example of a difference in extent between the more and the less extensive flank surfaces of the cutting element shown in FIG. 6.

As shown in FIG. 7, a difference in flank width W between the more extensive 20 and less extensive 22 flank surfaces may be selected to maintain approximately the same crest width on both the more extensive 16 and less extensive 18 crest segments where the particular design of the step crest cutting element 14 includes such more extensive and less extensive flank surfaces. As previously explained, however, a step crest cutting element according to the invention may include such more and less extensive flank surfaces on both, on only one, or on neither flank.

It should also be noted that while the embodiments of the invention shown herein are described as being used with a bit having three roller cones, any number of roller cones can be used with a drill bit according to the invention.

The invention has been described with respect to specific embodiments. It will be apparent to those skilled in the art that the foregoing description is only an example of the invention, and that other embodiments of the invention can be devised which do not depart from the spirit of the invention as disclosed herein. Therefore, the scope of the invention is intended to be limited only by the scope of the claims that follow.

What is claimed is:

1. A drill bit, comprising:

a bit body;

at least one roller cone attached to the bit body and able to rotate with respect to the bit body;

a plurality of cutting elements disposed on the at least one roller cone, at least one cutting element including a step shaped crest on its outer surface, the step shaped crest including at least one more extensive crest segment and a less extensive crest segment corresponding thereto, the at least one cutting element disposed in a gage row, the more extensive crest segment disposed toward a gage side of the bit.

2. The drill bit as defined in claim 1 wherein the at least one of the cutting elements further comprises at least one more extensive flank surface and a corresponding less extensive flank surface, the flank surfaces corresponding to the at least one more extensive crest segment and the corresponding less extensive crest segment, respectively.

3. The drill bit as defined in claim 2 wherein a difference in extent between the more extensive and the less extensive flank surfaces is selected to substantially maintain a same crest width between the more extensive and less extensive crest segments.

4. The drill bit as defined in claim 1 wherein a difference in extent between the more extensive and the less extensive crest segments is selected to correspond to a penetration depth of an earth formation at which first fracture failure is expected to occur.

5. The drill bit as defined in claim 1 wherein a difference in extent between the more extensive and less extensive crest segments is about 0.200 inches (0.51 centimeters).

6. The drill bit as defined in claim 1 wherein the at least one cutting element is disposed in a gage row.

7. The drill bit as defined in claim 1 further comprising a cutting element including a step shaped crest on its outer surface, the step shaped crest including at least one more extensive crest segment and a less extensive crest segment corresponding thereto, the cutting element disposed in an innermost row.

8. The drill bit as defined in claim 1 wherein the at least one cutting element comprises a milled steel tooth.

9. The drill bit as defined in claim 1 wherein in the at least one cutting element comprises a hard material insert.

10. The drill bit as defined in claim 1 wherein in the at least one cutting element comprises a superhard material insert.

11. A drill bit, comprising:

a bit body;

at least one roller cone attached to the bit body and able to rotate with respect to the bit body; and a plurality of milled steel teeth disposed on the at least one roller cone, at least one of the teeth including a step shaped crest on its outer surface, the step shaped crest including at least one more extensive crest segment and a less extensive crest segment corresponding thereto, the at least one of the teeth is disposed in a gauge row on the at least one roller cone, the more extensive segment disposed toward a gage side of the bit.

12. The drill bit as defined in claim 11 wherein the at least one of the teeth further comprises at least one more extensive flank surface and a corresponding less extensive flank surface, the flank surfaces corresponding to the at least one more extensive crest segment and the corresponding less extensive crest segment, respectively.

13. The drill bit as defined in claim 12 wherein a difference in extent between the more extensive and the less extensive flank surfaces is selected to substantially maintain a same crest width between the more extensive and less extensive crest segments.

14. The drill bit as defined in claim 11 wherein a difference in extent between the more extensive and the less extensive crest segments is selected to correspond to a penetration depth of an earth formation at which first fracture failure is expected to occur.

15. The drill bit as defined in claim 11 wherein a difference in extent between the more extensive and less extensive crest segments is about 0.200 inches (0.51 centimeters).

16. The drill bit as defined in claim 11 further comprising at least one additional tooth having a step shaped crest on its outer surface, the step shaped crest including at least one more extensive crest segment and a less extensive crest segment corresponding thereto, the at least one additional tooth disposed in an innermost row.

* * * * *